US007448099B2

(12) United States Patent
Abernathie

(10) Patent No.: US 7,448,099 B2
(45) Date of Patent: Nov. 11, 2008

(54) ATTACHMENT FOR OPERATING TABLE

(76) Inventor: Dennis L. Abernathie, 5320 S. Highway 163, Columbia, MO (US) 65203

( * ) Notice: Subject to any disclaimer, the term of this patent is extended or adjusted under 35 U.S.C. 154(b) by 0 days.

(21) Appl. No.: 11/151,894

(22) Filed: Jun. 14, 2005

(65) Prior Publication Data

US 2006/0277682 A1 Dec. 14, 2006

(51) Int. Cl.
*A61G 13/10* (2006.01)

(52) U.S. Cl. ..... 5/507.1; 5/503.1; 108/49

(58) Field of Classification Search ..... 5/507.1, 5/503.1, 658; 108/49
See application file for complete search history.

(56) References Cited

U.S. PATENT DOCUMENTS 3,859,993 A * 1/1975 Bitner ..... 128/847
4,113,218 A * 9/1978 Linder ..... 248/291.1
5,152,486 A * 10/1992 Kabanek et al. ..... 248/201
5,362,021 A * 11/1994 Phillips ..... 248/276.1
5,375,276 A * 12/1994 Nelson et al. ..... 5/620
5,511,674 A * 4/1996 Boyd et al. ..... 211/70.6
5,681,018 A * 10/1997 Hoftman ..... 248/125.8
6,298,507 B1 * 10/2001 Clyburn ..... 5/623

* cited by examiner

*Primary Examiner*—Michael Trettel
(74) *Attorney, Agent, or Firm*—Spencer Fane Britt & Browne LLP

(57) ABSTRACT

The present invention provides an attachment for an operating table preferably including two base portions adapted to rest on the frame of an operating table, a frame portion adapted to support a tray within the sterile field during surgery, and at least two support portions extending upwards from the first and second base portions, respectively, in order to support the frame portion.

4 Claims, 3 Drawing Sheets

ATTACHMENT FOR OPERATING TABLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates generally to an attachment for an operating table and, more specifically, to an operating table attachment adapted to support a tray within the sterile field of the operating table and to be raised or lowered in conjunction with the raising or lowering of the operating table.

During a typical surgical procedure, a surgeon may require the use of various instruments or devices to aid in the surgery. Due to the nature of surgery, it is important that any such instruments or devices be within easy reach of the surgeon and, moreover, be sterile. Current practice is to affix certain necessary devices, such as retractors or navigation devices, to rails on the side of an operating table. This is problematic in that the rails on the side of an operating table are located outside of the sterile field maintained during surgery. Manipulation of these devices at the point of attachment to the railing poses a risk of contamination.

With respect to instruments and the like needed during surgery, one prior art method of providing these instruments to a surgeon is to place them onto Mayo stands, which are then positioned over the legs of the patient during surgery. This is less than satisfactory, however, because at times during the surgical procedure, such as, for example, when lateral x-rays are required, the operating table must be raised or lowered. The corresponding need to raise or lower the Mayo stands is inconvenient, particularly given the fact that twenty pounds or more of instrumentation may be present on the stands, and also poses a risk of contamination.

What is needed, therefore, is an attachment for an operating table that will raise and lower with the operating table, provide a surface for instrumentation and the like within the sterile field, and provide a rail or other attachment portion for devices within the sterile field.

BRIEF SUMMARY OF THE INVENTION

The present invention provides an attachment for an operating table including two base portions adapted to rest on the frame of an operating table, a frame portion adapted to support a tray within the sterile field during surgery, and at least two support portions extending upwards from the first and second base portions, respectively, in order to support the frame portion.

In one alternative embodiment of the present invention, at least one fastener is provided in order to removably attach at least one of the base portions to the frame of the operating table.

In another alternative embodiment, a rail portion is also provided, attached preferably to the side of the frame portion of the device facing the operative site, to provide a usable rail within the sterile field.

In yet another alternative embodiment of the present invention, the frame portion of the present device is provided with a tray situated therein or integral thereto.

It is contemplated that the device of the present invention may be provided with protective pads positioned along the underside of the base portions in order to prevent marring of the surface of an operating table when the present device is in use. Further, the present device may be constructed such that the frame portion of the device may be provided as a cantilevered structure, thereby allowing, in the event of an emergency, the expedient removal of the frame from a position over the body of a patient.

The present device may be constructed from a variety of suitable materials and may be formed from separate portions fixedly attached to one another, or as a single, unitary whole.

DETAILED DESCRIPTION OF THE INVENTION

Figure 1:
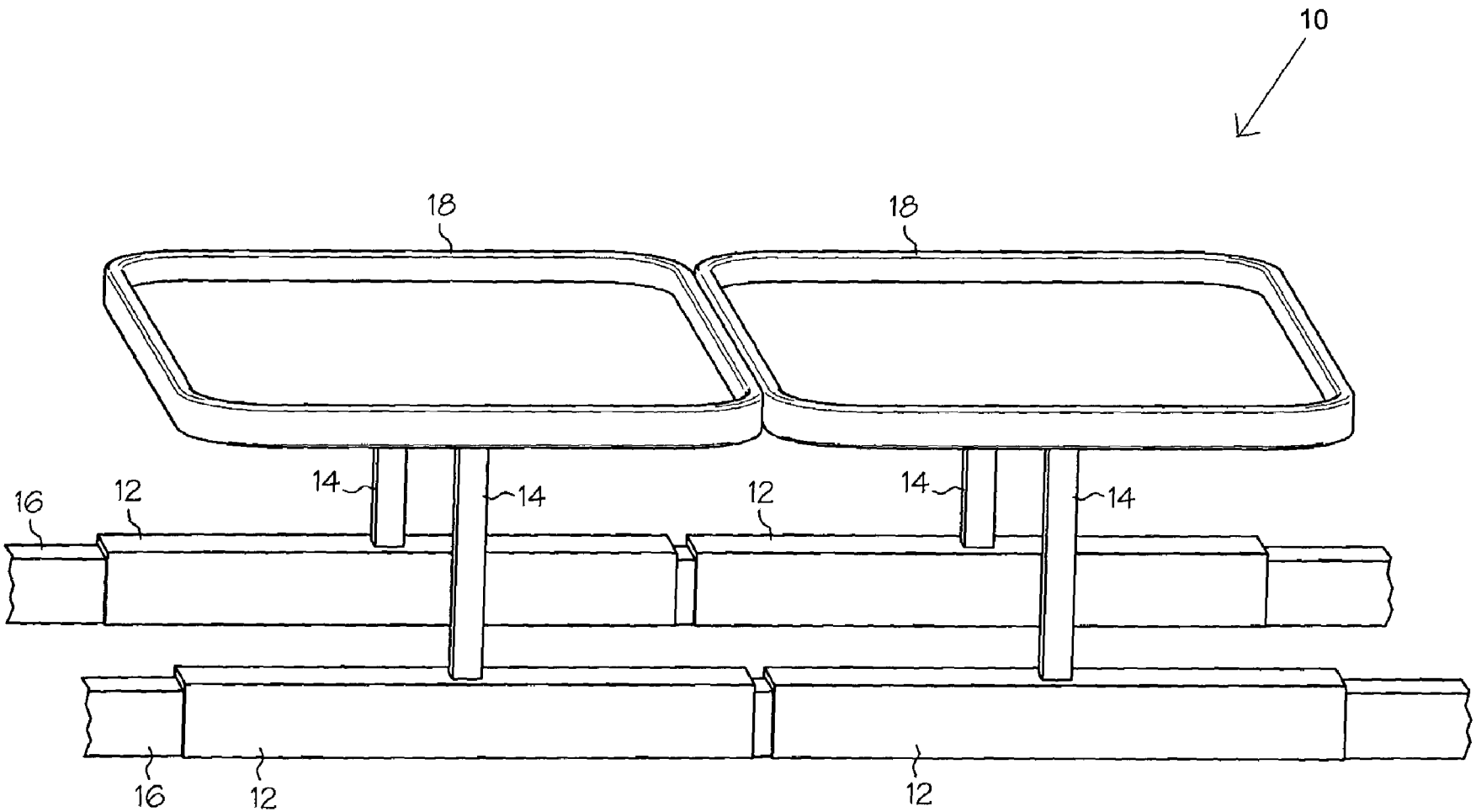
FIG. 1 is a perspective view of one embodiment of the present invention.

Turning now to the drawings, wherein like numerals designate like parts, the numeral 10 indicates generally an operating table attachment constructed in accordance with the teachings of the present invention. FIG. 1 provides an illustration of such a device. In the embodiment shown in the figure, the device includes base portions 12, which serve to contact the frame 16 of the operating table upon which device 10 is situated. As shown, each of the base portions is formed from an elongated L-shaped piece of material that has been turned on its side in order to fit onto the frame of the operating table and hold the attachment device securely thereto. The L shape of the base portions prevents the attachment, to a large extent, from being jostled, or from being pulled or pushed from the operating table during a surgical procedure. This structure of base portions 12 also minimizes the amount of sliding that may occur if the operating table is positioned at an angle. It is understood, however, that although L-shaped base portions are shown in the figures, base portions having any suitable size and/or shape may be used in the present invention.

Figure 2:
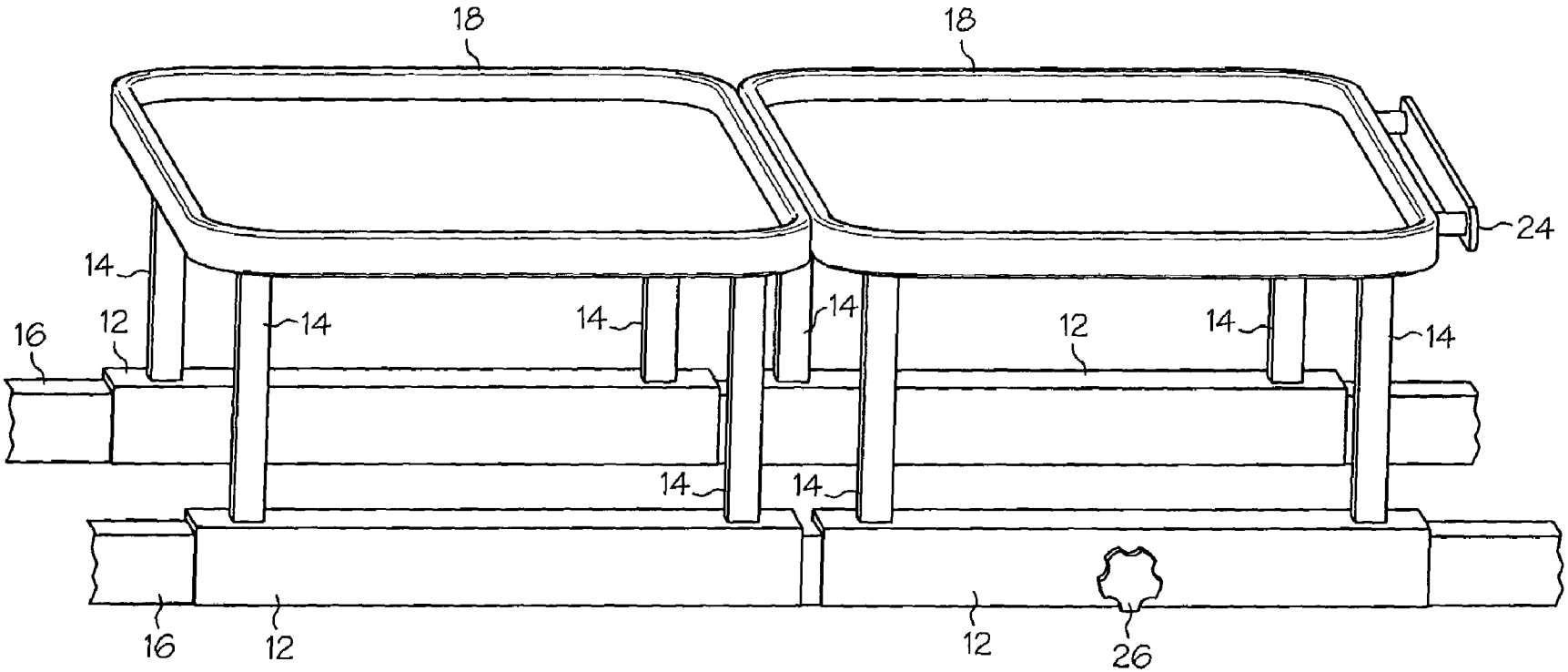
FIG. 2 is a perspective view of an alternative embodiment of the present invention depicting a fastener and rail associated therewith.

Extending upward from each base portion is at least one support portion 14. Support portions 14 are preferably fixedly attached to base portions 12, such as by welding if base portions 12 are constructed from metal. The embodiment of the present device shown in FIG. 2 includes two support portions 14 extending upward from each base portion, said support portions being located approximately at each of the ends of base portions 12. It is contemplated that a single base portion 14 may extend upwardly from the center of each of base portions 12 or, alternatively, that more than two support portions may be associated with each base portion. Though support portions 14 shown in FIGS. 1 and 2 are fixed in length, it is contemplated that they may also be adjustable in length so that the frame 18 of device 10 may be raised or lowered independently of the operating table by simply extending or retracting the length of support portions 14. The construction of variable-length support portions 14 may be accomplished by any suitable method known in the art.

Frame 18 of device 10 is preferably formed of a single piece of material that defines a perimeter around the top portion of device 10. The formation of a perimeter around the top portion of device 10 results in the creation of an opening interior to frame 18, which opening is adapted to receive a tray or other object (not shown) having a surface for supporting surgical instruments during surgery. The height of frame 18 with respect to a surgeon utilizing device 10 during a surgical procedure may be varied by raising or lowering the operating table itself, or in the embodiment of device 10 having variable length support portions 14, by extending or retracting support portions 14. In an alternative embodiment of the present invention, frame 18 may be include a tray portion integrally formed therein rather than simply providing a receptacle for receiving a tray. Additionally, frame 18 may be replaced by a flat, platform-like structure, such as a table structure, that constitutes a single piece mounted upon support portions 14. As used herein, 'platform portion' includes any flat, or approximately flat structure such as a tray or table.

FIG. 2 depicts an alternate embodiment of the present invention having a rail portion 24 provided within the sterile field, as well as a fastener 26 to further stabilize the attachment of device 10 to an operating table.

Rail portion 24 is shown attached to frame portion 18, such that rail portion 24 is positioned within the sterile field. This positioning of rail portion 24 also results in rail portion 24 facing the operative site during a surgical procedure. While it is preferred that rail portion 24 is attached as shown, it is contemplated that rail portion 24 (or a plurality of rail portions) may be provided attached to other portions of device 10, preferably being attached in each case within the sterile field established for the surgical procedure. Devices such as navigation devices or retractors may be attached to rail portion 24 and, thus, clamps associated with such devices may be manipulated by hand without the operator's hands leaving the sterile field and risking contamination.

Fastener 26 is preferably provided, as shown, associated with any of base portions 12. In the embodiment shown in FIG. 2, fastener 26 includes a knob portion and a screw extending through base portion 12 (not shown). When this embodiment of device 10 is in use, the knob of fastener 26 is turned in order to thread the screw further into base portion 12 such that the distal end of the screw contacts frame 16 of the operating table. In this way, device 10 is more securely fastened to the frame of the operating table. It is contemplated that a fastener 26 may be provided with any or all of base portions 12 in order to provide even further security in the attachment of the present device to an operating table. Though the fastener 26 depicted in FIG. 2 is of the knob and screw variety, it is contemplated that any suitable fastener known in the art may be used.

Figure 3:
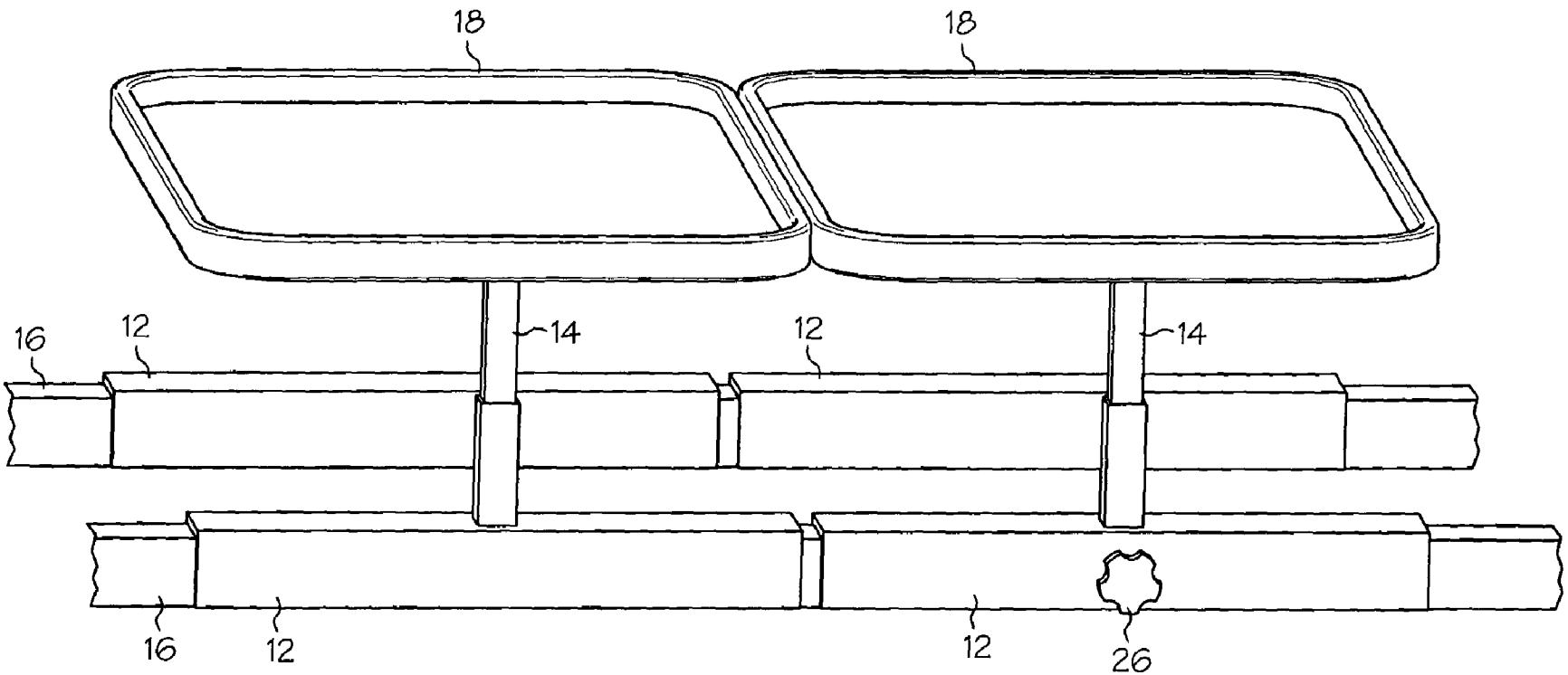
FIG. 3 is a perspective view of the an alternative embodiment of the present invention wherein the upper frame of the device is attached to a support portion in a cantilevered fashion, so that the frame is rotatably movable.

FIG. 3 depicts another embodiment of the present device wherein frame portion 18 of the device is adjustably attached to a support portion 14 in a cantilevered manner. As such, frame portion 18 may be rotated in an upward direction such that it is no longer positioned over the body of a patient lying on the operating table. This feature of this embodiment of the present invention allows for the expedient removal of the patient from the operating table in the event of an emergency, without the need to remove the entire operating table attachment of the present invention.

In any of the embodiments described above, it is preferred that protective padding (not shown) is provided on the underside of base portions 12 so that the surface of the operating table is not marred when the present device is in use thereupon.

As can be seen in the drawings, base portions 12 of the various embodiments of the present invention engage a substantial surface area of the frame 16 of an operating table relative to the size of the attachment as a whole. This engagement provides a great deal of stability to attachment 10 and inhibits the displacement thereof during normal use. Displacement of a traditional attachment to an operating table may occur when a person in the operating room puts pressure on the attachment, or even when heavy instruments are placed on a tray associated with an attachment or elsewhere on the attachment itself. The present device is resistant to such displacement during ordinary use because of the surface area of the operating table frame engaged by the present device, as described above. In embodiments of the present device having protective pads associated therewith, the protective pads may further inhibit displacement of the device. This is crucial in an operating room setting wherein RFID or other tags are used to track the attachment and various instruments thereon using a computerized tracking and/or imaging system. Even a slight displacement of the attachment can lead to erroneous data being received by such a computer system. Thus, the configuration of the present device renders it remarkably suitable to use in a setting wherein such a computerized system is being used.

It is preferred that the present device be constructed of stainless steel, in which case individual portions of the present device are fixedly attached to one another by means of welding or the like. It is contemplated, however, that various other suitable materials, such as, for example, plastic or wood, may be used in the construction of the present device. The various portions of the present device may be attached to one another by any means suitable to the materials used in the construction of the device, and may even be removably attached to one another for easy deconstruction and transport of the device if necessary. It is further contemplated that the entire structure of the present device may be constructed from a single, unitary piece of material such as, for example, plastic, and that in any of the above embodiments a tray or other surface may be provided in conjunction with, or as part of, frame portion 18.

Though the present invention is shown in the drawings as including two separate structures (each including one or more base portions, support portions, and a frame), it is contemplated that one such-structure may be used instead of two, if so desired by the user. The single structure may be of the same relative size as those shown in the figures, or a single structure may be designed to provide as much, or more, surface area as the dual-structure configuration shown in the drawings. Any suitable dimensions may be used in the construction of the present device.

The foregoing description of the embodiments of the invention has been presented for purposes of illustration and description, and is not intended to be exhaustive or to limit the invention to the precise form disclosed. The description was selected to best explain the principles of the invention and practical application of these principles in order to enable others skilled in the art to best utilize the invention in various embodiments and with such modifications as are suited to the particular use contemplated. It is intended that the scope of the invention not be limited by the specification, but be defined by the claims as set forth below.

The invention claimed is:

1. An attachment for an operating table comprising:

at least one base portion adapted to rest upon at least a portion of a frame of an operating table;

at least one support portion fixedly attached to each of said at least one base portions and extending upward therefrom;

an upper platform portion fixedly attached to at least one of said at least one support portions; and a protective pad on said at least one base portion for protecting a surface to which said attachment is attached and inhibiting displacement of said attachment during ordinary use thereof.

2. The attachment of claim 1 wherein when said at least one base portion rests upon at least a portion of a frame of an operating table, said at least one base portion engages a sufficient surface area of said frame of an operating table so as to substantially prevent displacement of said attachment during ordinary use thereof.

3. An attachment for an operating table comprising:

a first base portion adapted to rest upon at least a portion of a frame of an operating table;

a first support portion fixedly attached to said first base portion and extending upward therefrom;

a second base portion adapted to rest upon at least a portion of said frame of said operating table;

a second support portion fixedly attached to said second base portion and extending upward therefrom;

a protective pad on at least one of said first and second base portions for protecting a surface to which said attachment is attached and inhibiting displacement of said attachment during ordinary use thereof and an upper frame portion fixedly attached to said first support portion and said second support portion, said upper frame portion defining a perimeter of said attachment and adapted to receive a tray, wherein when said first and second base portions rest upon at least a portion of a frame of an operating table, said first and second base portions engage a sufficient surface area of said frame of an operating table so as to substantially prevent displacement of said attachment during ordinary use thereof.

4. An attachment for an operating table comprising:

a base portion adapted to rest upon at least a portion of a frame of an operating table;

a support portion fixedly attached to said base portion and extending upward therefrom; an upper frame portion fixedly attached to said support portion and a protective pad on said base portion for protecting a surface to which said attachment is attached and inhibiting displacement of said attachment during ordinary use thereof, wherein when said base portion rests upon at least a portion of a frame of an operating table, and said base portion engages a sufficient surface area of said frame of an operating table so as to substantially prevent displacement of said attachment during ordinary use thereof.

* * * * *